United States Patent [19]

Kranz et al.

[11] 3,942,559

[45] Mar. 9, 1976

[54] ELECTROFLUIDIC CONVERTER

[75] Inventors: Walter Kranz, Taufkirchen; Heinz Tillmann, Ottobrunn, both of Germany

[73] Assignee: Messerschmitt-Bölkow-Blohm Gesellschaft mit beschränkter Haftung, Germany

[22] Filed: Sept. 6, 1974

[21] Appl. No.: 503,698

[30] Foreign Application Priority Data

Sept. 26, 1973 Germany ..... 2448308

[52] U.S. Cl. ..... 137/831; 137/832; 137/835

[51] Int. Cl.[2] ..... F15C 1/08; F15C 3/00

[58] Field of Search ..... 137/834, 835, 836, 837, 137/829, 831, 832; 251/137, 139, 140, 141

[56] References Cited

UNITED STATES PATENTS

| | | | |
|---|---|---|---|
| 2,912,008 | 11/1959 | Blackburn | 251/137 X |
| 3,231,233 | 1/1966 | Herion | 251/141 X |
| 3,340,896 | 9/1967 | Mon et al. | 137/835 X |
| 3,357,441 | 12/1967 | Adams | 137/831 |
| 3,402,727 | 9/1968 | Boothe | 137/835 X |
| 3,426,800 | 2/1969 | Bauer | 137/831 X |
| 3,486,517 | 12/1969 | Gaura | 137/832 |

*Primary Examiner*—William R. Cline
*Attorney, Agent, or Firm*—McGlew and Tuttle

[57] ABSTRACT

The converter includes a pressure fluid operated, bistable fluidic element, in the form of a fluid oscillator, having a pressure fluid supply inlet opening into an interaction chamber, two outlets extending downstream from the interaction chamber to the exterior and diverging in direction at an acute angle, two control inlets communicating with the interaction chamber, and a magnetic system actuated by electric input signals and influencing the control pressure in the control inlets to deviate the pressure fluid from one outlet to the other outlet. Respective feedback conduits are branched from the outlets to respective associated control inlets. Valve arrangements are selectively actuable by the magnetic system to close or open the feedback conduits. In one embodiment of the invention, a single valve is provided in the form of an armature of the magnetic system. In another embodiment of the invention, each control inlet has a respective valve therein in the form of an armature of the electromagnetic system. In each embodiment, the valves open in the direction of fluid flow through the feedback conduits. Fluidic capacities may be connected to the feedback conduits, and the control inlets may be connected to a pressure source through loading conduits.

9 Claims, 3 Drawing Figures

ELECTROFLUIDIC CONVERTER

FIELD AND BACKGROUND OF THE INVENTION

This invention relates to an electrofluidic converter including a pressure fluid operated, bistable fluidic element having a pressure fluid supply inlet opening into an interaction chamber, two outlets extending downstream from the interaction chamber to the outside or exterior and diverging in direction at an acute angle, two control inlets commuicating with the interaction chamber, and a magnetic system actuated by electric input signals and influencing the control pressure in the control inlets to deviate the pressure fluid from one outlet to the other outlet.

Such electrofluidic converters are used, for example, in control circuits where the input quantity is an electric signal while the manipulated variable is a fluid signal. German OS No. 1,817,651 discloses an electrofluidic converter of the type mentioned which can be used in household appliances, such as washing or dish washing machines, as a directional water switch. The control conduits of the bistable, fluidic element, designed as a pure fluidic logic element, are closed alternately by means of an electromagnetically displaceable tongue. Due to the suction effect of the pressure fluid flowing through the bistable fluidic element, the pressure in the control inlet which is just closed is less than that in the open one so that, through the difference between the control pressures, the pressure fluid in the outlet associated with the closed control inlet is deviated.

However, in general, a switching operation produced by the suction effect of the bistable fluidic element is slower than one which is responsive to a pressure or power impulse rapidly transmitted in the control inlets. Thus, the limit frequency of this electrofluidic converter is relatively low and is further restricted by the inertia and the spring constant of the elastic tongue, as well as by the relatively large air gaps between the elastic tongue and the magnetic system.

Moreover, the limiting frequency of a control circuit comprising an electrofluidic converter is determined by the limiting frequency of the latter, even through the respective value of the electric part of the entire hybrid control circuitry may be relatively easily chosen very high. In order not to reduce the quality of the entire hybrid circuitry unnecessarily, an effort must be made to obtain a limiting frequency, of the electrofluidic converter, which is as high as possible. At the same time, the design of the electrofluidic converter should be such as to permit an operation with relatively feeble electric input signals.

SUMMARY OF THE INVENTION

The present invention is, therefore, directed to a control mechanism of an electrofluidic converter of the type mentioned in the beginning, which is designed so as to obtain a very high amplification factor and very high limiting frequency.

In accordance with the invention, this is obtained by providing the bistable fluidic element of the converter in the form of a fluid oscillator in which, at each outlet, a feedback conduit is branched off and leads to the respective control inlet, and each feedback conduit is adapted to be closed or opened by means of a valve which is actuated by the magnetic system.

Advantageously, the valves are designed as seating valves with a movable valve body forming the armature of the respective magnetic system, and the opening direction of the valve body coincides with the flow direction of the pressure fluid through the respective feedback conduit.

In an electrofluidic signal converter according to the invention, the switching operation is initialed in the same manner as in a feedback fluid oscillator, i.e., by a powerful pressure impulse which is transmitted in the feedback conduits at sound velocity. If the feedback conduits are correspondingly dimensioned, the frequency of such fluid oscillators amounts to approximately 1000 Hz. See MULTRUS, "Pneumatische Logikelemente und Steuerungs-Systeme" (Pneumatic Logic Elements and Control Systems), published by Krausskopf-Verlag GmbH, Mainz (Germany), 1970, p. 198.

The electrofluidic converter is switched, so that the oscillation of the fluid oscillator is interrupted, by closing one of the feedback conduits. For switching over, the feedback conduit which is just closed, is opened by lifting the armature from the valve seat and the hitherto open feedback conduit is closed. The switching operation of the valve is considerably supported by the pressure fluid flowing through the feedback conduit and, if the fluidic element is correspondingly dimensioned and the supply pressure is correspondingly high, the frequency of the electrofluidic converter is affected by the inertia of the valve to only a small extent. For these reasons, even switching times of one millisecond are obtainable with the electrofluidic signal converter embodying the invention.

The mentioned support of the switcing operation by the pressure fluid itself also involves the advantage that the magnetic system has to produce only the force for retaining the armature of the valve in the closing position, which forces are very small for small air gaps which are easily obtainable in this case.

For the mentioned reasons, the amplification factor of the electrofluidic signal converter is very high so that, in many cases, the electric input signals can be applied to the magnetic systems directly, i.e., without preamplification.

In one embodiment of the invention, the electrofluidic converter is provided with a control block comprising two chambers which are connected to each other by a straight passage in which a closing body, designed as an armature of the magnetic system and sealed relative to the passage wall, is shiftably mounted, and that each of the chambers is connected to one of the control inlets as well as to one of the feedback conduits each of which leads into the chamber in the shifting direction of the armature and through an orifice which is closable by the latter.

In this embodiment, the armature operates as a closing body for both feedback conduits. At a switching over of the magnetic system, the armature is lifted from its instantaneous seat by the magnetic force and accelerated toward its second seat for closing the other feedback conduit. This operation is simultaneously supported by the pressure fluid flowing into the chamber. In this embodiment, care must be taken that the armature closes the other feedback conduit within the switch-over time of the fluidic element, in order to prevent the bistable fluidic element from switching over already upon a small lifting of the armature from the seat. This can done by connecting a capacity to each of the feedback conduits so that the flow in the feedback conduits acts on the armature a longer time.

The construction of this electrofluidic signal converter, in which, for exmaple, the sealing of the armature in the passage connecting the two chambers must be such that the armature is movable almost without friction, can be simplified further by providing a separate valve for each of the feedback conduits. Preferably, this is done so that the armature, as the movable body of a seating valve, is mounted directly in the feedback conduit and retained in its closing position by the magnetic system and a spring.

An object of the invention is to provide a control mechanism for an electrofluidic converter which is designed so as to obtain a very high amplification factor and a very high limiting frequency.

Another object is to provide such a control mechanism of an electrofluidic converter including a bistable fluidic element in the form of a fluid oscillator.

A further object of the invention is to provide a control mechanism of an electrofluidic converter in which, at each outlet, a feedback conduit is branched off and leads to a respective control inlet, with each feedback conduit being adapted to be closed or opened by a valve actuated by a magnetic system.

Still another object of the invention is to provide such a control system for an electrofluidic converter in which the opening direction of each valve coincides with the flow direction of the pressure fluid through the associated feedback conduit.

For an understanding of the principles of the invention, reference is made to the following description of typical embodiments thereof as illustrated in the accompanying drawing.

DESCRIPTION OF THE PREFERRED EMBODIMENTS

Figure 1:
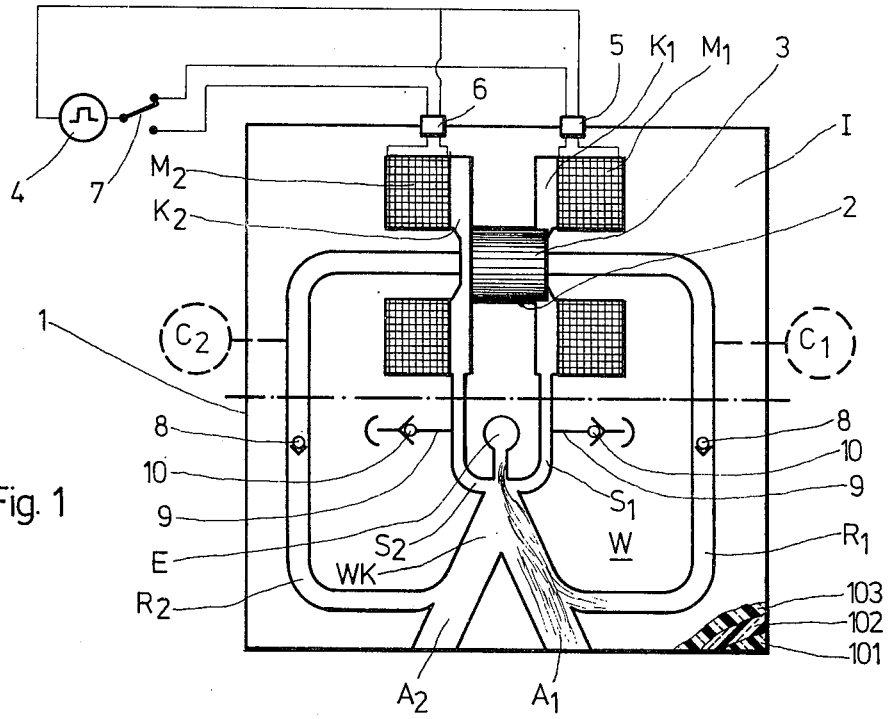
FIG. 1 is a top view of one embodiment of electrofluidic converter in accordance with the invention.

In the embodiment of the invention shown in FIG. 1, an electrofluidic converter is mounted in a plate assembly 1 constituted, for example, of a transparent plastic and assembled from three individual plates 101, 102 and 103. Plate 101 serves as a baseplate, plate 102 is an intermediate plate having the different, and hereinafter described, passages of the converter cut therein, and plate 103 serves as a cover plate.

More particularly, the electrofluidic converter comprises a bistable, pure fluidic logic element W formed with an interaction chamber WK, a supply inlet E leading into this chamber, two outlets $A_1$ and $A_2$ and two control inlets $S_1$ and $S_2$.

The control mechanism of the converter is located in a part of plate assembly 1 and, in the embodiment of FIG. 1, is designed as a control block I, including two chambers $K_1$ and $K_2$ which communicate with each other through a passage 2. An armature 3 is displaceably mounted in passage 2 and is sealed with respect to the passage wall, this armature being movable by means of two magnetic systems $M_1$ and $M_2$. Electric input signals of an electric circuit 4 are supplied to magnetic systems $M_1$ and $M_2$ through leads extending from the baseplate assembly 1 through bushings 5 and 6. By means of a switch 7, magnetic systems $M_1$ and $M_2$ may be energized by electric circuit 4 alternately so that, as seen in the drawing, armature 3 is reciprocated between the righthand side and the lefthand side.

Respective feedback conduits $R_1$ and $R_2$ are branched off outlets $A_1$ and $A_2$ of fluidic element W and lead into respective chambers $K_1$ and $K_2$ in the respective directions of displacement of armature 3, each feedback conduit containing a respective check valve 8. The orifices of feedback conduits $R_1$ and $R_2$, opening into the respective chambers $K_1$ and $K_2$, are adapted to be closed by armature 3, so that armature 3 acts as the movable switching valve body of a seating valve.

When neither of the magnetic systems $M_1$ and $M_2$ is energized, the electrofluidic converter operates in the following manner. As soon as bistable fluidic element W is supplied with pressure fluid through supply inlet E, the pressure fluid jet issuing from interaction chamber WK engages, due to the Coanda Effect, the outer wall of outlet $A_1$, for example, and leaves the fluidic element through this outlet. However, a portion of the pressure-fluid jet is deflected into feedback conduit $R_1$ so that, at sound velocity, a pressure impulse is transmitted therethrough effecting a displacement of armature 3 to the lefthand side. Thereby, on the one hand, the orifice of feedback conduit $R_2$ is closed and, on the other hand, since the pressure impulse is transmitted into control conduit $S_1$, the pressure fluid jet is deviated into outlet $A_2$ of the fluidic element. In this other direction, a portion of the pressure fluid jet is again deflected into feedback conduit $R_2$ so that the pressure impulse produced thereby displaces armature 3 to the righthand side, whereby, the orifice of feedback conduit $R_1$ is closed and the pressure fluid jet is deviated back into outlet $A_1$. The arrangement described acts as a fluid oscillator.

If, however, magnetic system $M_1$ is now energized, armature 3 is retained in its position closing feedback conduit $R_1$. The pressure fluid leaves the fluidic element through outlet $A_1$. Upon switching over switch 7, magnetic system $M_1$ is de-energized and magnetic system $M_2$ is energized so that armature 3 is lifted from the orifice of feedback conduit $R_1$. Then, armature 3 is under action of the magnetic forces of magnetic system $M_2$ and, simultaneously, under the static pressure present in feedback conduit $R_1$ and applying against the entire surface area of armature 3. The switching operation of armature 3 is thereby notably supported.

After armature 3 has been lifted from the orifice of feedback conduit $R_1$, the pressure fluid jet, as mentioned before, is deviated from outlet $A_1$ to contact $A_2$. If, in a new switching operation, the magnetic system $M_2$ is de-energized and magnetic system $M_1$ is energized, the described switching operation takes place in the inverse direction.

In addition, the switching operation can be optimized as will now be described. As already mentioned above, the bistable fluidic element switches over already when armature 3 has been lifted from its seat only a very small distance. To prevent a new switching over of the fluidic element W before armature 3 has closed the other feedback conduit, both feedback conduits are provided with respective capacities $C_1$ and $C_2$, so that the support of the switching operation by the pressure fluid acting on the armature is maintained for a longer time.

If the pressure fluid is supplied through the supply inlet into the interaction chamber at a high speed, the low pressure zones thereby produced at both sides of the pressure fluid jet cause an at least partial removal, by suction, of the pressure fluid present in control conduits $S_1$ and $S_2$, by which effect the dead time of the fluidic element is increased. To prevent this result, control conduits $S_1$ and $S_2$ are connected, through respective loading conduits 9, having a check valve 10, for example, to the outer atmosphere or to a pressure fluid tank.

Figure 2:
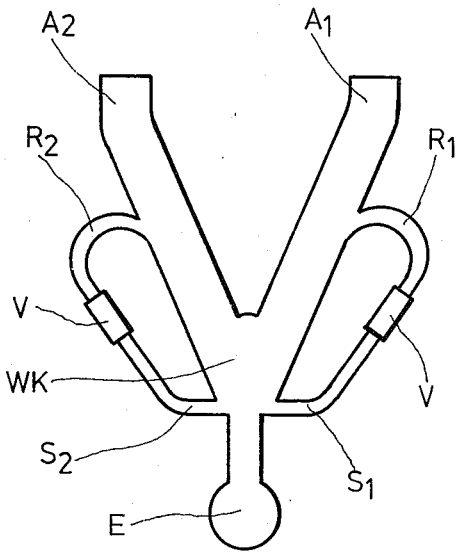
FIG. 2 is a top view of another embodiment of electrofluidic converter in accordance with the invention.
Figure 3:
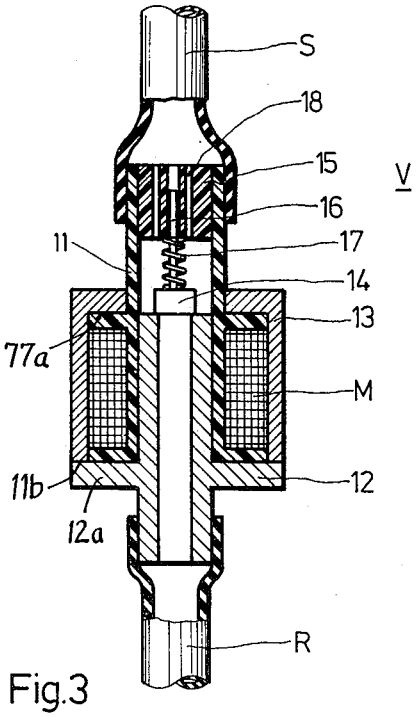
FIG. 3 is a sectional view of a valve mounted in one of the feedback conduits of the electrofluidic converter shown in FIG. 2.

The embodiment of the invention shown in FIGS. 2 and 3 differs from that shown in FIG. 1 substantially in the provision of a respective electromagnetically actuable seating valve V in each feedback conduit $R_1$ and $R_2$. A nonrepresented electric circuit ensures that the seating valves ae alternately closed by the electric input signals.

The seating valve is rotationally symmetrical and, as shown in FIG. 3, assembled of a plurality of rotationally symmetrical component parts. A supporting body 11 of insulating material, such as injection-molded plastic, carries a magnet coil M received between two flanges 11*a* and 11*b* and, at the same time, serves as a slip-on socket for one of the control conduits S. At the side remote from control conduit S, another socket 12, also provided with a flange 12*a* and made of magnetic material, is received in the supporting body 11 and cemented therein. A cap 13, having an L-shaped cross-section and also made of magnetic material, is connected to the flange of socket 12 so that a magnetic circuit is formed by socket 12, its flange 12a, and cap 13. One of the feedback conduits R is slipped over socket 12. In the valve housing thus formed, a piston designed as an armature 14 is mounted by means of a piston rod 16 which is loosely guided in a guide sleeve 15. In addition, a pressure spring 17 is provided between armature 14 and guide sleeve 15, biasing armature 14 against the upper rim of socket 12, which is formed as a seat surface, and thereby closing the connection between feedback conduit R and control conduit S.

The area of armature 14 does not occupy the entire crosssectional area of supporting body 11. Also, guide sleeve 15 is provided with passages 18 so that, with armature 14 in lifted position, the pressure fluid can flow from feedback conduit R into control conduit S.

If the magnetic systems of the check valves, thus designed, in the electrofluidic converter are not energized, the converter operates, as already described in connection with the first embodiment, as a fluid oscillator. For example, if the pressure fluid flows from supply inlet E through outlet $A_1$, a portion of this pressure fluid is deflected into feedback conduit $R_1$. The pressure impulse thereby produced lifts armature 14, against the force of spring 17, from the seat, and passes into control inlet $S_1$ whereby, the pressure fluid jet is deviated from outlet $A_1$ into outlet $A_2$. As soon as bistable fluidic element W has switched over, armature 14 is again pressed against its seat by means of spring 17.

If, after the switching of the fluidic element W, the pressure fluid flows through outlet $A_2$, a portion of the jet is again deflected into the feedback conduit $R_2$, whereupon, the seating valve in the feedback conduit $R_2$ is opened and the fluidic element switches over again.

As soon as one of the magnet coils M is energized the associated armature 14 is retained on its seat on socket 12 and the respective feedback conduit R is thereby closed. The pressure fluid then flows through the outlet which is associated with the closed feedback conduit. Upon de-energizing of magnetic system M, the full static pressure of the feedback circuit is applied against armature 14 so that the latter is lifted from its seat and a portion of the pressure fluid flows into control conduit $S_1$. As mentioned, the fluidic element W switches over. If the magnetic system of seating valve 11, mounted in feedback conduit $R_2$, is energized and thereby the feedback conduit $R_2$ closed, a new switching operation takes place only after this magnetic system is de-energized and the pressure impulse thereupon transmitted through control circuit $S_2$ impinges on the pressure fluid jet in the interaction chamber.

The last described embodiment of an electrofluidic converter is of particularly simple construction because, aside from the exact fit of the seat of armature 14, no constructional problems arise. Also, the feedback conduits $R_1$ and $R_2$ and the control conduits $S_1$ and $S_2$ may be designed as flexible tubes of which each is slipped over one end of the seating valve. Preferably, the electrofluidic converter of this construction will be embedded in plastic.

While specific embodiments of the invention have been shown and described in detail to illustrate the application of the principles of the invention, it will be understood that the invention may be embodied otherwise without departing from such principles.

What is claimed is:

1. An electrofluidic converter, for converting electric signals into corresponding fluid signals, comprising, in combination, a pressure fluid operated, bistable fluidic element having a pressure fluid supply inlet opening into an interaction chamber, two diverging outlets extending downstream from the interaction chamber to the outside, and two control inlets opening into the interaction chamber; two feedback conduits each branched from a respective outlet and connected to the corresponding control inlet, so that a fluid oscillator is thereby constituted; a seating valve arrangement including movable valve body means engageable with valve seat means to close said feedback conduits, said valve body means being movable in an opening direction coinciding with the flow direction of the fluid through said feedback conduits; and a magnetic system actuated by electric input signals and operatively associated with said seating valve arrangement to control said valve body means to close or open said feedback conduits.

2. An electrofluidic converter as claimed in claim 1, including a control block formed with two chambers connected to each other through a rectilinear passage; said valve means comprising a movable valve body shiftably mounted in said passage and sealed relative to the interior surface of said passage; said valve body constituting an armature of said magnetic system; each chamber being connected to a respective control inlet and to a respective feedback conduit, and said shiftable valve body being adapted to open and close said feedback conduits in alternation.

3. An electrofluidic converter as claimed in claim 2, in which each feedback conduit communicates with the associated chamber in the direction of shifting of said shiftable valve body and through an orifice closable by said shiftable valve body.

4. An electrofluidic converter as claimed in claim 3, including a respective fluidic capacity connected to each feedback conduit.

5. An electrofluidic converter as claimed in claim 1, in which said valve means comprises respective seating valves mounted directly in each feedback conduit and controlling communication between the respective feedback conduit and the associated control inlet; each valve being a seating valve having a movable valve body formed by a magnetic armature; said magnetic system including respective magnetic means operatively associated with each magnetic armature.

6. An electrofluidic converter as claimed in claim 5, including respective springs biasing each magnetic armature into the closing position.

7. An electrofluidic converter as claimed in claim 5, in which each valve includes a valve body formed with a pair of sockets for respective slip-on connection to a feedback conduit and to the associated control inlet.

8. An electrofluidic converter as claimed in claim 1, including respective loading conduits connecting the control inlets of said bistable fluidic element to a pressure source.

9. An electrofluidic converter as claimed in claim 1, including respective loading conduits connecting the control inlets of said bistable fluidic element to atmosphere.

* * * * *